United States Patent [19]

Cichos

[11] 4,372,088

[45] Feb. 8, 1983

[54] STRUCTURE WITH SLAB BEAMS

[75] Inventor: Claus Cichos, Wehrheim, Fed. Rep. of Germany

[73] Assignee: Bärbel Cichos, Wehrheim, Fed. Rep. of Germany

[21] Appl. No.: 219,167

[22] Filed: Mar. 10, 1980

[30] Foreign Application Priority Data

Mar. 8, 1979 [DE] Fed. Rep. of Germany ..... 2908995

[51] Int. Cl.[3] ..... E04B 1/00

[52] U.S. Cl. ..... 52/251; 52/259; 52/236.8

[58] Field of Search ..... 52/250, 251, 253, 259, 52/236.6, 236.7, 236.8

[56] References Cited

U.S. PATENT DOCUMENTS

| | | | |
|---|---|---|---|
| 2,053,873 | 9/1936 | Niederhofer | 52/213 |
| 2,202,745 | 5/1940 | Muse | 52/259 X |
| 3,300,943 | 1/1967 | Owens | 52/236.8 X |
| 3,533,204 | 10/1970 | Wallace et al. | 52/250 X |
| 3,604,177 | 9/1971 | Clyne | 52/250 X |
| 3,645,056 | 2/1972 | Gerola | 52/259 |
| 3,693,308 | 9/1972 | Trezzini et al. | 52/259 X |
| 4,019,293 | 4/1977 | Armas | 52/259 X |
| 4,147,009 | 4/1979 | Watry | 52/259 X |
| 4,211,045 | 7/1980 | Koizami et al. | 52/251 |

*Primary Examiner*—Price C. Faw, Jr.
*Assistant Examiner*—Carl D. Friedman
*Attorney, Agent, or Firm*—Kenyon & Kenyon

[57] ABSTRACT

A structure such as a building has floors formed from horizontal slab beams and walls formed from vertical slab beams. Only the ends of the beams of the slab beams are connected to each other and to supporting elements.

10 Claims, 9 Drawing Figures

STRUCTURE WITH SLAB BEAMS

BACKGROUND OF THE INVENTION

The invention relates to a structure, or building, with floors and walls which are formed from slab beams. A slab beam comprises an integrated unit formed by a slab and by laterally interspaced beams to which the slab is integrally connected. The slab beam can be made as a precast concrete section, for example, and transported to a building site.

Construction parts forming rooms must not only be rigidly and immovably disposed on one another, i.e., fixedly connected to one another so that the entire structure remains robust and can be safely utilized when exposed to the action of any possible external and internal forces; but also they must be insulated, i.e., separated, from one another to such an extent that disturbing external and internal elements do not encroach upon persons residing within the rooms. To achieve this, finished room demarcation surfaces should be made at the bottom, top and sides at the same time, so that without further treatment they can be covered and/or painted while providing special cavities for installing supply and disposal systems without the individual design in the size and arrangement of the room being impaired.

It is known that the entire stability and security against fracture of the individual sections in multi-story buildings, is predominantly provided by setting individual stories directly one above the other so as to be as resistant as possible to bending. The necessary insulation against sound and heat loss, finished room demarcation surfaces, and parts for the house installation system, however are joined on and inserted or supplemented independently as subsequent measures, but only on surfaces which are still accessible to handling after the supporting construction has been erected.

In addition, there are disadvantages from additional dead weight, as well as perfect functioning being dependent on the conscientiousness of the craftsmen.

It is also known that ventilation cavity cladding, or cladding secured to a base, improves heat and sound insulation. However, this has been done only on the vertical external surfaces of the structure and not on all sides for a room or a room sequence. It is further known that finished room demarcation surfaces can be semi-finished reinforced concrete parts (filigree ceilings, and all ceilings and wall units) which are supplemented by special plane connection measures with in situ concrete to form monolithic solid construction parts. But, in the case of ceilings, this is carried out only on the underside and without simultaneous protection from footfall sound from above and without included heat insulation, and with extensive sound bridge formation through the completely monolithic construction. House piping arrangements are not taken into consideration here either. The same applies to in situ concrete walls and ceilings in smooth exposed concrete formwork, and to self-supporting prefabricated constructions which are all directly supported and monolithically connected. In addition, in the case of double-formwork design there are disturbing influences from necessary anchor elements and inaccuracies in design.

SUMMARY OF THE INVENTION

The object of this invention is to avoid unnecessary weight, to decrease the load on the individual support elements so as to save material, to improve the insulation properties of a structure through its supporting construction, and to decrease the sound and low thermal bridges of the bearing surfaces, and to achieve an advance in prefabrication regarding the final state and size of parts in conjunction with a quick and safe assembly, as well as to pre-specify ranges for house installations through the supporting construction without restricting the individual design of the rooms and room sequence.

Briefly, the invention provides a multi-story structure in which not only the floors, but also the walls are formed from slab beams, and that for sound and heat insulation of the rooms, the horizontal and vertical slab beams of a room are secured to supporting elements only by way of the beams of the slab beams, in particular of the slab beams of the room situated above and/or below another room.

The rooms or room sequences are separated so that the surfaces bordering them are no longer integral joint surfaces, but rather lie parallel to one another. Necessary bearings are achieved indirectly and in only a few knot-like contact points interspaced from each other.

At such points where the beams are secured to one another (junction points) the points are resistant to bending (rigid). All vertical loads are received by the vertical beams (supports) of the vertical slab beams so that the vertical slabs remain without loading. A continuous gap can exist between superposed vertical slabs. Only the vertical beams of the slab beams are dimensioned according to load and height of structure. The vertical walls or slabs have only a reinforcing effect, bracing the beams.

There can be continuous heat insulation between all the rooms to be separated as well as to the outside, apart from the very slight thermal bridges at the junction points of the beams.

Statically, the construction works like a skeleton or frame construction made up of beams, and no bending of the frame can arise since the slabs prevent beam bending and also produce a strutting arrangement for the beams parallel to the slabs.

Sound in a floor slab beam is reduced by the beams of the floor slab beam and further decreased by rigid ring beams to which only the beams connect. The sound is then transferred punctiformly into the lower wall and there damped again by the beams of the lower wall slab beam.

A self-supporting spatial construction composed of plane individual sections with insulation on all sides can be provided with outer installation and point-like, knot-like supporting to multi-story rooms.

The special design of the individual sections allows both an indirect support and complete room demarcation which produces an almost completely continuous separation of the individual rooms or room sequences in the structure and thereby provides increased sound and heat insulation. For separation of the room or room sequences, two plane individual sections are used in each case which provide the corresponding room demarcation, the smooth visible sides of which are finished off by covering or painting and the uneven sides of which remain unseen in the structure as they face one another. Floor, ceiling and wall plastering are unnecessary. Moreover, later insulation is not necessary.

The insulation inserted in a horizontal cavity which can be formed between two spatial supporting frame-works, can be constructed as combined heat and sound insulation of any desired characteristics because this insulating layer is not stressed and therefore not compressed. In vertical cavities, it can be constructed as continuous meshing with free unstressed crushing capacity.

For the punctiform support and frame-like construction to form multi-story blocks of rooms, steel hollow or box sections or steel half-open or channel sections can be used, the construction being achieved with an internal concrete filling in the section and external concrete slabs fixed to the sections. In addition, poured in place ring beams are used at the steel sections end in such a manner that each steel section is drilled at the corresponding points, and straight or bent concrete reinforcing steel rods are passed through. Thereby the various cavities can be reinforced continuously with inserted concrete reinforcing steel and then concreted so that prefabricated parts can be anchored simply and safely. It is no longer necessary to weld on wall plugs.

Insulated suspension stays can be drawn on assembly, by extension cables through anchoring openings in the individual parts to be assembled so that it is not necessary to subsequently assemble the fixed parts after the individual part lying thereabove has been inserted.

The demarcation of two adjacent rooms which is separated into two individual parts makes these parts individually lighter. Further, connecting points are reduced and surface effects increased.

In order to cause the punctiform support of the supporting frame, in the production of its individual parts, a template can be used which places the beams (reinforced concrete prefabricated units or steel hollow sections) necessary for punctiform support, in the exact position according to plan and holds them there until this task is taken over by the hardened concrete of the slab. Important markings for the individual part and markings for further individual parts are made on this template, whereby markings belonging together can be identified by corresponding coding. At the same time the template is constructed to be so strong that it can be used as a transport girder.

The construction according to the invention also permits particularly simple static calculation. Further forms are not necessary for the ring beams since the insulating layers which are carried by the already standing construction parts (ceiling slab, floor slab) provide forms while the floor slabs provide a form for the front sides.

DESCRIPTION OF THE DRAWINGS

Embodiments of the invention are schematically represented in the accompanying drawings, the various figures being described below.

DETAILED DESCRIPTION OF THE INVENTION

Figure 1:
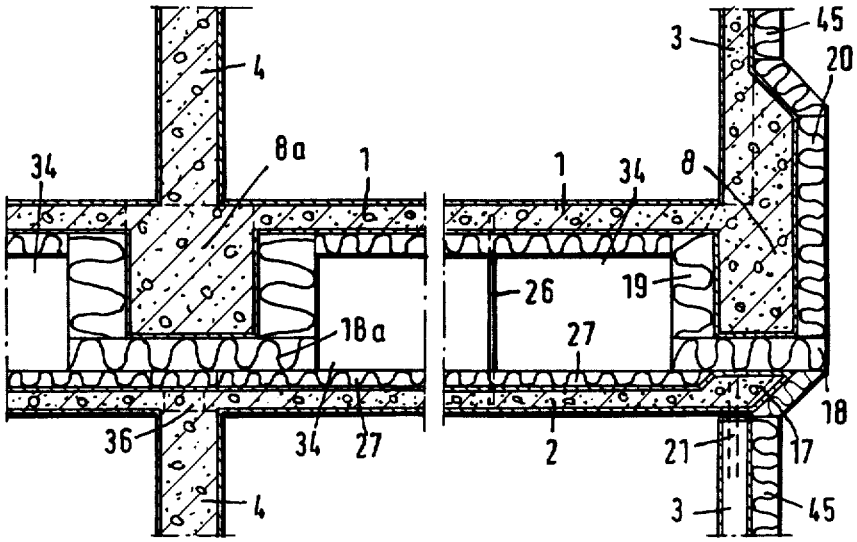
FIG. 1 is a vertical section through a part of a structure point between two beams of the slab beams.

For the described punctiform support, the bearing effect of the floor and ceiling slabs 1, 2 and side wall slabs 3, 4 must be reduced to what are, in effect, points. Therefore, they are constructed as slab beams (slab with monolithically connected beams) out of a pure concrete cross-section or a compound cross-section, and so that the beams 7 project each beyond the slabs and rest or bear on the bearing surfaces and can be connected together via encircling ring beams 8 to form the entire structure. The distances between the height of the beams and the thickness of the slabs and plates depend on the individual design of the structure, the individual spans and loads.

A room or room sequence is marked by various slab beam surfaces which can be structured differently, but the slab beams must be aligned at the bearing points with respect to the distances between beams. Series produced reinforced concrete prefabricated units with connecting reinforcement are used with particular advantage for the slab (pure reinforced concrete cross-section), with steel hollow or box section or half-open or channel rolled steel joists or beams (compound cross-section), whereby joining is achieved by concrete reinforcing steel bars 12 bent on one end and inserted via straight ends, on different sides and so as to fit exactly, through bores 11 through the sides 9 (parts in FIG. 6 stressed predominantly by shear) of the rolled steel joist or beam shell in direct proximity of the sections flange 10 (parts predominantly stressed at normal force) in sufficient proportion and at a necessary distance. In the case of the horizontal hollow sections *7a* of FIG. 2 (flectional beams) they are filled with concrete as the inner concrete cross-section of the compound cross-section. The ends of the concrete reinforcing steel bars 12 which are bent and straight on alternate sides and project out from the beam, run into the upper or lower continuous reinforcement 13 of the slab in a further concreting process of the compound cross-section. The shear of the compound cross-section of concrete and steel cross-section is thereby absorbed by shear forces at the concrete reinforcing steel and effective bearing forces in the rolled steel joist. In the same way thrust forces of the beam *7a* projecting at the end beyond the slab or plate are absorbed, whereby the bores 11 are distributed over the entire depth of the rolled steel joist cross-section. The continuous concrete reinforcing steel serves as the longitudinal reinforcement of a ring beam 8 which connects the beams which meet at the knot-like contact points. In the case of the vertical steel hollow sections (supports) the compound reinforcement 12 is inserted in the same way; the hollow cross-section is not however filled with concrete but the concrete slab of the compound cross-section is joined on first.

In the assembly of the vertical slab beam 3 (wall part) concrete reinforcing steel 14 is passed through the ring beam by simple insertion from above into the vertical steel hollow section lying below, which is filled with concrete to about half level, as far as the upper steel hollow section. The inside of the upper half of the lower steel hollow section and the inside of the lower half of the upper steel hollow section are then filled with concrete during pouring of the ring beam, whereby a part of the ring beam longitudinal reinforcement, as is the case with horizontal slab beams, is directed through bores 11 over the entire height at the ends of the vertical steel hollow cross-sections. Thus, the normal forces are directed from the steel cross-section of the upper compound slab beam over the ring beam 8 into the lower one. Hence simple in situ reinforced concrete parts serve as the connecting means of the compound slab beam to the knot-like contact points.

If the normal forces of the vertical steel hollow cross-section become so great that they can no longer be directly transferred via effective bearing and shearing forces into the concrete of the ring beam and from there back into the steel hollow section, then the steel hollow sections should be provided at these points with head and base plates which are cut out in the center to correspond to the hollow cross-section. When using pure reinforced concrete beams, ring stirrups (not shown) with connecting rods take over the function of the steel hollow section, whereby the longitudinal reinforcement of the reinforced concrete beams is bent at each of their ends in such a way as to bring about a bend-resistant connection with the ring beam. The ring beam 8 can be constructed as lintel or binding beams by way of openings (windows, doors) in the vertical slab beams 3, to absorb loads from the vertical slab beams 3 and other construction parts and to accommodate windows, shutters, air vents and such.

To be able to connect the horizontal and vertical slab beams 1, 3 at the few knot-like contact points, to the entire structure, the beams 7*a* are secured to templates T by connections in the form of steel bars 14 running transversely thereto (screw and plug-in connection). While the slab 1, 3 is being poured on jolting tables, the beams 7*a* are held over them so as not to be displaced from the templates. The templates at the same time serve as support girders, after the concrete has set and hardened, for turning and transporting the slab beams 1, 3. They are then used in further production for the next slab beams, whereby—as far as the same knot-like contact points of the structure should be connected to—the beams are secured to the same fixed holding units of the template. The beams are necessarily therefore spaced at the same distance (inaccuracies can be accepted with the slabs). Different spacing sequencies can thereby be marked for the beams on the very same template if they are marked accordingly as correlating sequence (markings 15 in FIG. 8 by color, numbers). Also, further features are marked on the template such as piping, openings and such including their appropriate holding means.

The assembly of a structure is carried out after transport of the slab beams via the girder-shaped template T. Simple screw brackets are used for this as assembly fixtures (not shown). A load bearing internal and external wall unit 3 (vertical slab beam) is temporarily supported with its slab on the slab of the floor element 1 (horizontal slab beam) on a plastic-insulated washer 16 (FIG. 2). Of note, the upper floor (ceiling) slab 2 including an edging 17 on its end with horizontal insulation 18 lying on top and an insulation 19 attached to the floor plate 1, provide two sides of the form work for the outer ring beam 8. The third outer side is closed by mobile outer forms including inserted outer insulation 20 after the ring beam reinforcement has been inserted and the outer ring beam 8 is poured with the adjoining halves of the lower and upper steel hollow sections 7*a* of the wall unit (vertical slab beams) 3. Lower and upper wall units 3 and floor element 1 are thereby connected to one another and transfer the perpendicular loads there. Also, the slab of the floor element 1 and of the upper wall unit 3 are bound in the ring beam 8 to be resistant to bending, but the slab of the ceiling unit 2 and the lower edge upper wall unit 3 are not bound to the ring beam 8. The latter two units are connected with one another so as to be slightly resistant to bending or freely swingable by way of a hinge anchor pin 21 (FIG. 1) and remain continuously separated from the ring beam 8. Floor and wall units of the upper story are thus joined together in the ring beam so as to be resistant to bending, the ring beam being only supported on the beam 7*a* of the wall unit 3 of the lower story so as to be resistant to bending and rest thereon as if on supports.

Figure 2:
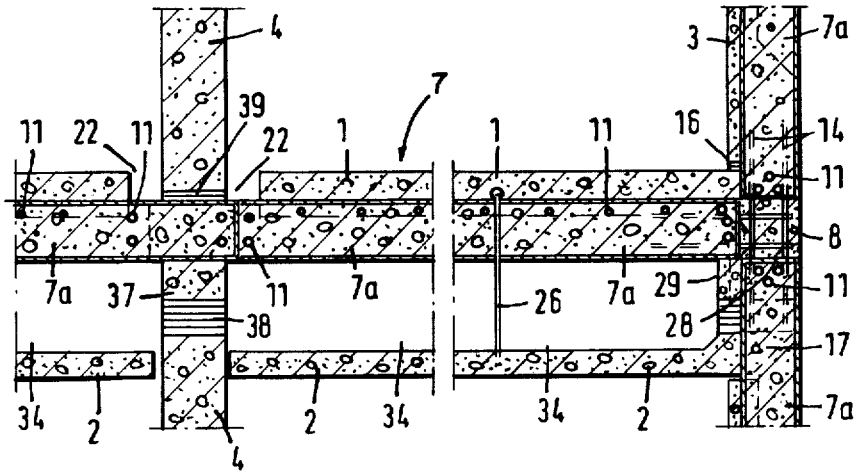
FIG. 2 shows a section according to FIG. 1 but taken through the beams of the slab beams, the insulating slabs being left out.
Figure 3:
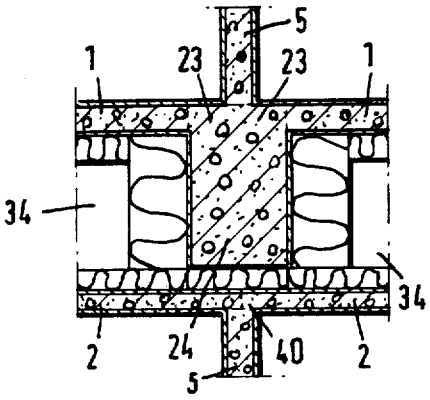
FIG. 3 is a vertical section taken through a vertical non-supporting dividing wall in the area of the flooring and ceiling.
Figure 4:
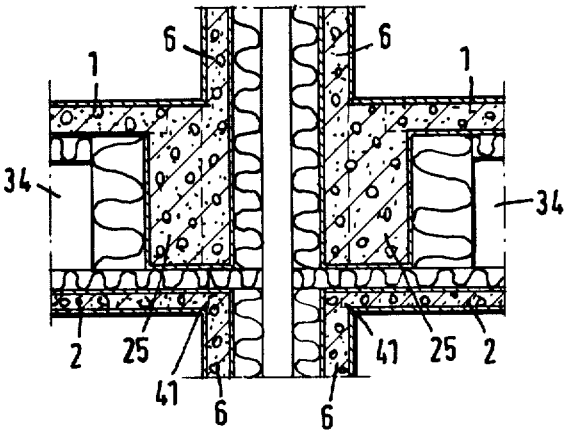
FIG. 4 is a section corresponding to FIG. 3 but taken through a non-supporting double-formwork dividing wall.

The support in an inner ring beam 8*a* is achieved in a similar manner by way of a reinforced concrete inner wall plate 4; however, here the load-bearing inner wall plate can be single-shuttered if it is not to insulate rooms or room sequences completely from one another. The inner ring beam 8*a* with connecting reinforcement 11 (also reinforcement of the wall plates 4) of all the parts meeting there is filled with concrete by way of lateral gaps 22 (FIG. 2) between the slab 1 of the floor unit and the wall plate 4. The load-bearing wall units 3 (vertical slab beam) and wall plates 4 (single-shutter reinforced concrete finished parts) are thus fixed at the bottom and stand free. Non-bearing dividing wall plates 5 (FIG. 3) are then attached and anchored to and transversely between the bearing walls 3, 4 with their supports (not shown) jutting out at the top. They hang free as dividing units and at the bottom run into a gap 23 between two adjacent slabs 1 of the floor element. The dividing wall plate 5 and slab 1 of the floor unit are filled with concrete through these gaps 23 in the area of their connecting reinforcements (connecting beams 24). Dividing wall plates 6 (FIG. 4) are constructed to be double-shuttered without joint anchoring and are connected at the bottom merely on one side with in situ concrete 25 to the respective slab 1 of the floor element of the same room.

Upper floor (ceiling) units 2 are composed of simple thin slabs since they do not have to support any actual load other than installation pipes. These units 2 are laid on load-bearing and non-bearing walls (where necessary on additional auxiliary yokes), and may be constructed to protect the floor under sides against fire, to reduce weight and save material and can be set in porous concrete for heat insulation. Also, they can be held on the floor element 1 positioned thereabove as a suspended ceiling by way of suspension stays 26, anchored in the supporting walls on the side with hinge pins 21 (FIG. 1) which hold them so that they are freely rotatable at this point. If loads are to be supported then the slabs 2 can be constructed as slab beams. After the house pipe installations have been laid and insulation preparations made as formwork 18, 18*a* on the underside for the ring beams 8 to be poured thereabove, the upper floor elements 2 are covered with granular insulation material 27 for heat insulation and damping of sound energy (also use of insulation meshes, in particular crushable mineral insulation meshes). The floor element is temporarily supported on plastic-insulated bed plates 29 on individual hump-like elements 28 (FIG. 2) of the upper floor unit in the edge area below the beams *7a* of the floor element 1 to be bound in the ring beams 8.

During erection, (FIG. 9) in order to lower the floor element 1 the suspension stays 26 of the upper floor unit 2 are passed through the openings 31 in the floor element 1 with extension cables 30 and released again after the stays 26 have been drawn through. The stays are securely connected from above with the floor element 1, and the openings 31 closed in the slab 1 of the floor element. In the case of balconies and canopy roofs, the beams *7a* of the floor element pass through the external wall and are heat insulated all around outside to the necessary length. Reinforced concrete units composed of floor slabs with parapet are positioned and adjust to the insulation (floating support). The undersides are suspended beforehand with corresponding reinforced concrete, wood, metal or plastic elements and anchored to the top (suspended ceiling). The ventilation cavity cladding 32 (FIG. 7) is also formed by suspended plates 33 between the window lines and held at the sides by the outer casing of the window parapet.

The (suspended) ceilings 2 no longer support any actual loads and can therefore be adapted easily to correspond to the insulation requirements. The flooring 1 is no longer stressed by additional dead weight (from floating plaster). Corresponding costs and material are saved. It is possible due to division into ceiling element 2 and floor element 1 to produce the two remaining visible surfaces perfectly and also for immediate application of paint or covering, whereas the facing sides of the two elements are left in their raw state and serve to simply receive the heat and sound insulating layers which remain completely unstressed and thus have full effect at any time and can be constructed to be almost of unrestricted thickness and can be combined for sound and heat insulation by loose packing or formation of crushed zones. Undesired dropping, possibly due to compressed floating plaster, no longer arises. The ceiling element increases the fire protection in relation to the untreated underside of the flooring. In addition, cavities 34 (FIGS. 1-2) are created due to the division into ceiling and floor element, in which cavities 34 the house pipe installations are easily laid, whereby rigid holding elements which disturb insulation can be avoided. The separation of elements, besides permitting the separation in function connected therewith and the more exact and adaptable selection of material and form as well as the additional creation of cavities 34, provides the further advantage that the individual elements are lighter due to saving in material and division of tasks or can be prefabricated to be larger but retaining the same weight (reduced joint formation).

The knot-like point support outside the areas marked into rooms allows all protective measures to be carried out more thoroughly and more effectively (in the case of small supporting areas the static cooperation of slab and beams can be abandoned and the slab supported indirectly on the beams as a further insulation measure). The load reduction can be pursued more easily and exactly by the reduction in support on points, whereby a safer and more complete utilization of the material properties is possible. This is supported by the complementary effects of slab and beams which are each stressed vertically and horizontally in both surface directions, whereby the beams reinforce the thin slabs and the slabs brace the highly stressed beams. This is increased by the formation more or less of a skeletal support frame with monolithic connection of the individual parts by an in situ concrete. This provides a greater stability of the whole. The connections themselves are considerably simplified and more reliable in relation to the prefabricated part and steel connections, due to the use of concrete reinforcing steel in hollow cross-sections. This also applies to the improvement of the bond between rolled steel joist and concrete through inserted concrete reinforcing steel.

Due to the use of templates 14 (assembly girders) the accuracy in dimensions is increased already during production and errors limited to a minimum. The almost arbitrary arrangement of the beams in the slab beams permits the load applications from dividing walls and openings to be directly absorbed while also relieving or even supporting horizontal elements which may be susceptible to deflection. The cladding elements 33 are aligned by leaning them directly on the vertical strip insulation 35 of the beams of the vertical slab beams (wall unit) without any further auxiliary means and are held at the desired distance from the cavity ventilation.

Referring to FIG. 1, the monolithic composite unit 8a is formed by the upper central wall 4 (single formwork) and the two ceiling slabs 2 of the horizontal slab beams 1 (floor elements). The slabs are free from stress but form a monolithic composite unit 36 with the lower central wall 4. The monolithic composite unit 8 comprises the slab of the upper vertical slab beam 3 (wall unit) and the slab of the horizontal slab beam 1 (floor element) without contacting the freely rotatable holding unit of the slab of the suspended ceiling 2 (upper floor unit) and the slab of the lower slab beam 3 (lower wall unit). Also, the heat insulation 27 above the suspended ceiling (upper floor element) and the additional combined sound and heat insulation, is represented in such individual units as will be applied during production of the individual parts or after assembly.

FIG. 2 shows a vertical section along the beams *7a* of the slab beams 1, 3 with the supporting central wall 4 and external wall 3 of the structure. The left half of the figure shows the free bearing of the two beams of the horizontal slab beams (floor elements) on a hump-like or upward edging 38 of the lower central wall 4 (single formwork) via intermediate insulating plastic support 37, the anchoring 11 of the beams in the ring beam and the free bearing of the upper supporting central wall 4 (single formwork) thereon with inserted plastic balance support 39. The right half of the figure shows the bend-resistant connection of the beams *7a* (supports) of the upper and lower slabs 3 (upper and lower wall element) with beams *7a* having the horizontal slab 1 (floor element), and its intermediate support 28, 29, during the assembly on the slab of the suspended ceiling 2 (upper floor element) and the intermediate support 16 of the upper slab beam 3 (upper wall element) with its slab on the slab of the horizontal slab beam (floor element), and in each case inserted insulating plastic balance support 16.

Figure 5:
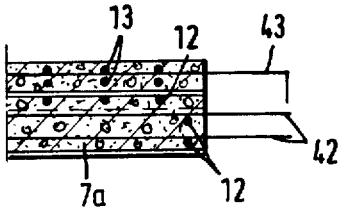
FIG. 5 is a section taken through a slab beam in the area of the beam lengthwise thereof.

FIG. 5 shows a longitudinal section through an end portion of a vertical 3 or horizontal 1 slab beam (steel hollow section) showing the hollow section *7a* with bores 11 for passage of the concrete reinforcing steel 12 into the stem areas 9, which faces the concrete slab, to the composite unit between slab and section *7a* and in the end area transversely to the hollow section *7a* to its anchoring in the ring beams 8, 8a, as well as the noose reinforcement 42 from the concrete in the hollow section *7a* and the bent reinforcement 43 from the slab.

Figure 6:
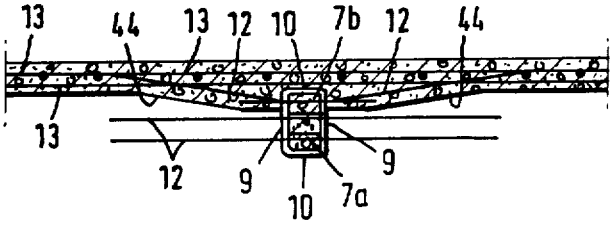
FIG. 6 is a section taken through a slab beam at a right angle to the beam.

FIG. 6 shows a section through a (vertical or horizontal) slab beam 1, 3 transversely to the beam *7a* (steel hollow section). Also represented: the steel hollow section with the connected slab, the right and left-hand haunch (incline) 44 for accommodating the steel rod reinforcement 12 bent on one side through the bores 11 of the hollow section *7a* and the straight plug reinforcement 12 in the end area of the section.

Figure 7:
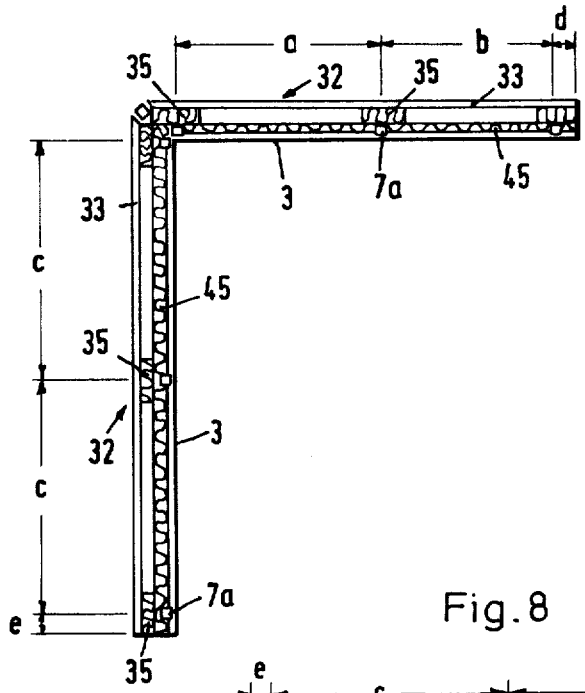
FIG. 7 is a horizontal section taken through two perpendicular adjoining walls made with slab beams.

FIG. 7 shows a horizontal section through a corner comprising two vertical slab beams 3 (wall elements). Also represented are two slab beams 3 with various distances between the beams (measurements a,b,c), lateral end measurements of the slab (measurements d and e), the insulation 35, 45 of beams and slab as well as the cladding elements 33 leading directly on the beam insulation 35. The example of FIG. 7 shows the slab without haunch (dependent on the static requirements).

Figure 8:
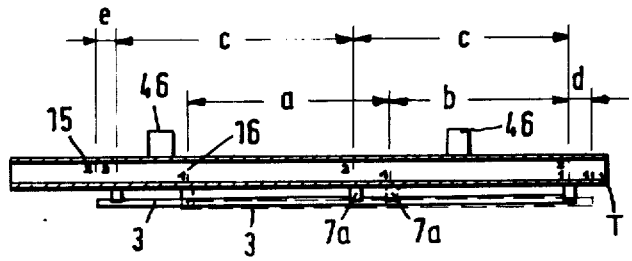
FIG. 8 shows a template or transport girder with an adjoined slab beam.

FIG. 8 shows the transport girder (with two lifting hooks 46) as template 14 and the marking 15 on the template (in this example for both slab beams 3 from FIG. 7) and the respective dimension according to the specifications in FIG. 7 (measurements a,b,c,d and e).

Figure 9:
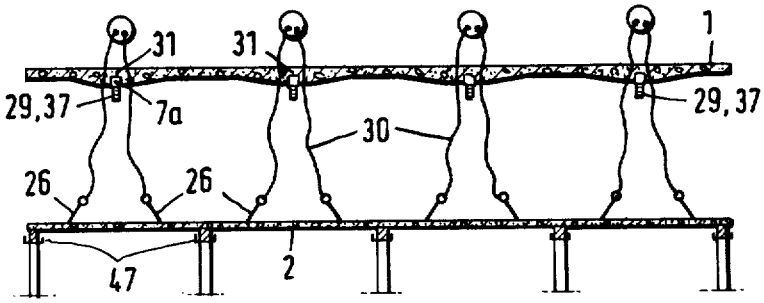
FIG. 9 is a vertical section taken through a ceiling slab and a floor slab while the ceiling slab is being lowered during assembly of a structure.

FIG. 9 shows a horizontal slab beam 1 (floor element) during assembly (lowering into its installation position without showing the girder, the lifting unit or the insulations) and the slab of the suspended ceiling 2 (upper floor element) which is temporarily supported on auxiliary yokes 47 for assembly. Here is represented how the suspension stays 26 are drawn through the anchoring openings 31 of the slab beam 1 to suspend the ceiling slab 2 on the beams *7a* of the horizontal slab beam 1 (floor element) on lowering the slab beam via extension cables 30. The insulating plastic bearings 29, 37 which are already secured to the beams *7a* before assembly, are also shown.

What is claimed is:

1. A structure comprising at least one horizontal slab beam having a steel beam and a concrete slab;

a pair of vertical slab beams disposed in vertically spaced relation to each other to define an outer wall, each vertical slab beam having a steel beam and a concrete slab; and a poured-in-place concrete beam having reinforcing steel therein connecting said steel beam of said horizontal slab beam to each said steel beam of said vertical slab beams, said poured-in-place concrete beam being spaced above said concrete slab of the lower one of said vertical slabs and being in unreinforced contact with said concrete slab of said horizontal beam and said concrete slab of the other of said vertical slabs.

2. A structure as set forth in claim 1 further comprising a second horizontal slab beam having a steel beam and a concrete slab adjacent said one horizontal slab beam;

a pair of vertically aligned wall plates located in a plane between said horizontal slab beams; and a poured-in-place concrete beam having reinforcing steel therein connecting said steel beams of said horizontal slab beams to each other at a joint with said wall plates being vertically spaced from said steel beams at said joint.

3. A structure as set forth in clain 1 which further comprises a horizontal ceiling slab spaced below said horizontal slab beam and resting on said concrete slab of a lower one of said vertical slabs.

4. A structure as set forth in claim 3 which further comprises a plurality of suspension stays suspending said ceiling slab from said horizontal slab.

5. A structure as set forth in claim 3 wherein said ceiling slab and said horizontal slab beam define a space therebetween for receiving insulation.

6. A structure as set forth in claim 1 wherein said beams of each said slab beam project beyond said slabs of said slab beam.

7. A structure as set forth in claim 1 wherein said steel beams are hollow sections filled with concrete.

8. A structure as set forth in claim 7 which further comprises reinforcement bars extending into said hollow sections in parallel relation and through said poured-in-place concrete beam.

9. A structure as set forth in claim 8 which further comprises reinforcement bars extending within said concrete slab of said horizontal slab beam transversely into said steel beam.

10. A structure as set forth in claim 1 which further comprises a slab covering an underside of said horizontal slab beam and having a bottom side finished and ready for decoration.

* * * * *